US005239834A

United States Patent [19]

Travers

[11] Patent Number: 5,239,834

[45] Date of Patent: Aug. 31, 1993

[54] AUXILIARY OUTSIDE AIR REFRIGERATION SYSTEM

[76] Inventor: Richard H. Travers, Rte. 1, Box 143-7, Warren, Vt. 05674

[21] Appl. No.: 912,696

[22] Filed: Jul. 13, 1992

[51] Int. Cl.[5] ..... F25D 17/00

[52] U.S. Cl. ..... 62/151; 62/180; 62/203; 236/49.3; 165/54; 165/16

[58] Field of Search ..... 62/180, 186, 151, 158, 62/140, 203, 409, 412, 332; 165/16, 53, 54; 236/49.3, 91 R

[56] References Cited

U.S. PATENT DOCUMENTS

| | | | |
|---|---|---|---|
| 1,600,522 | 9/1926 | Strehlke . | |
| 2,342,998 | 2/1944 | Bieret | 236/49.3 X |
| 2,407,036 | 9/1946 | Snavely | 236/49.3 X |
| 2,474,369 | 6/1949 | Ray | 236/91 R X |
| 3,479,836 | 11/1969 | McHale | 62/140 |
| 4,023,947 | 5/1977 | Ferry | 62/180 |
| 4,147,038 | 4/1979 | Hoebing et al. | 62/180 |
| 4,175,401 | 11/1979 | McManus | 62/180 |
| 4,178,770 | 12/1979 | Fox | 62/186 |
| 4,202,492 | 5/1980 | Rose | 236/49.3 |
| 4,244,193 | 1/1981 | Haakenson | 62/180 |
| 4,245,481 | 1/1981 | McDermott | 236/49.3 X |
| 4,250,716 | 2/1981 | Huffman | 62/180 |
| 4,358,934 | 11/1982 | Van Kirk | 62/180 |
| 4,369,916 | 1/1983 | Abbey | 236/11 |
| 4,619,114 | 10/1986 | Wilson | 62/332 X |
| 4,676,073 | 6/1987 | Lawrence | 165/16 X |
| 5,142,880 | 9/1992 | Bellis | 62/186 X |

OTHER PUBLICATIONS

Article in *Energy Management Matters*, "Cut Refrigeration Costs!", Central Maine Power Company; Augusta, Me.; Winter '89.

Advertising Flyer for "Freeaire" Outside Air Refrigeration System, Richard Travers, Author; Warren, Vt.; Dec., 1988.

*Primary Examiner*—Harry B. Tanner

*Attorney, Agent, or Firm*—Iandiorio & Dingman

[57] ABSTRACT

The invention pertains to an auxiliary outside air refrigeration system for use in combination with a conventional refrigeration system to supply refrigeration to an enclosure whereby cold outside air is used as the cooling medium. A differential thermostatic controller monitors the temperature inside the enclosure and in the outside atmosphere and, if the temperature inside the enclosure indicated the need for refrigeration, activates the fans of the auxiliary outside air system whenever the temperature differential between inside and outside indicates adequate potential for refrigeration. The conventional refrigeration system is energized only when the more energy-efficient outside air refrigeration system is not able to maintain adequate refrigeration within the enclosure. The controller can be used for an auxiliary outside air refrigeration system using direct exchange of air between the enclosure and the outside atmosphere or one using an air-to air heat exchanger.

13 Claims, 4 Drawing Sheets

AUXILIARY OUTSIDE AIR REFRIGERATION SYSTEM

BACKGROUND OF THE INVENTION

1. Field of the Invention

The subject invention generally pertains to refrigeration systems and more specifically to auxiliary refrigeration systems that use outside air for the cooling medium.

2. Description of the Related Art

Conventional refrigeration systems for walk-in coolers and other refrigerated enclosures almost always utilize a compressor, a condenser and an evaporator in order to remove heat from the space to be cooled. Such conventional systems are reliable and effective at performing this function, though the electrical energy consumed by such systems is substantial. One method of reducing the electricity needed to refrigerate an enclosure is to use an outside air refrigeration system that utilizes the cooling potential of cold outside atmospheric air whenever that air becomes cold enough to cool the enclosure more efficiently than can the conventional refrigeration system. Because cooling with outside air typically involves simply moving the air with fans, it is inherently more energy efficient than a more complicated conventional refrigeration system, if the outside air temperature is sufficiently cold, sometimes as little as 4 degrees (F) cooler than the temperature of the air inside the enclosure. The colder the outside air temperature gets the more energy efficient an outside air refrigeration system becomes, and the colder the climate the more energy and money that can be saved by utilizing an outside air refrigeration system. When the outside air temperature is 30 degrees F. cooler than the air inside the enclosure an outside air refrigeration system can be as much as ten times as efficient as a conventional refrigeration system. In roughly the northern half of the United States the outside temperature is low enough for a great enough time during the year to justify the installation of an outside air refrigeration system. Since a typical refrigeration temperature for perishable food is between 33 and 40 degrees F., there are, of course, few places where the outside atmospheric air temperature does not at times warm up to a point where outside air cannot be used for refrigeration, so to maintain constant, reliable refrigeration an outside air refrigeration system must usually be used in conjunction with and auxiliary to a conventional refrigeration system.

There have been a number of auxiliary outside air refrigeration systems proposed. Some of these systems, such as those described in U.S. Pat. No. 4,175,401 and 4,023,947, employ a control system having a "changeover" thermostat that senses the outside temperature and de-energizes the conventional refrigeration system and energizes an outside air refrigeration system whenever the outside temperature falls below a pre-determined temperature, typically a temperature that will usually be cool enough to refrigerate the enclosure regardless of the cooling load. Only one or the other of the two systems can operate at any one time, but not both. A problem with having a pre-selected "changeover" temperature setting is that the setting may at times be too warm, such that the cooling load of the enclosure is too great for the cooling capacity of the outside air system and the temperature inside the enclosure can rise to an unacceptable level. This can occur when a large warm load of product is introduced into the enclosure or doors to the heated portion of the building are opened frequently or for long periods and admit warm air into the enclosure. At other times this same changeover temperature setting may be too low. This can occur when the cooling load of the enclosure may be so low that outside air only a few degrees cooler than the air inside of the enclosure could satisfactorily refrigerate the enclosure, but is prevented from doing so because the low changeover temperature setting will not allow the thermostat to energize the outside air fan or fans. This results in a lost opportunity to save energy as the less energy efficient conventional refrigeration system will operate more than it needs to.

Another control strategy for outside air systems is to have no electrical interconnection between the conventional refrigeration system and the outside air system. This type of "independent" system is found in U.S. Pat. Nos. 4,250,716, 4,178,770, 4,147,038, 4,619,114, 4,244,193, and 4,358,934. The operation of each of these outside air systems is controlled by two thermostats, one sensing the outside temperature and one sensing the temperature inside the enclosure. The thermostat controlling the opeartion of the conventional refrigeration system is set at a higher operating range than the thermostat sensing the enclosure temperature for the outside air system. The conventional refrigeration system does not operate as long as the outside air system can adequately cool the enclosure. The outside air thermostat is set at a pre-determined cut-in temperature such that the outside air system will only be used when the outside air is cold enough to always be at least as efficient as the conventional refrigeration system. An "independent" system is preferable to a "changeover" type system because it allows simultaneous operation of both the conventional refrigeration system and the outside air system. The cut-in temperature setting of the outside air thermostat can be such that the outside air used is just cold enough to contribute to the refrigeration of the enclosure, and does not have to be cold enough to handle the refrigeration load alone, without help from the conventional refrigeration system. This results in the more efficient outside air system handling more of the refrigeration load in an "independent" system than it would with a "changeover" system and therefore more energy and money saved. However, a given cut-in setting of the outside thermostat of an "independent" outside air system can at times still be too low to make full use of the cooling potential of outside air. When the cooling load of the enclosure is great and the conventional refrigeration system cannot keep the temperature of the enclosure from rising, the pre-determined cut in temperature setting of the outside air thermostat may prevent the outside air system from operating, even though it could, given the temperature differential between the inside and outside air, more efficiently refrigerate the enclosure than can the conventional refrigeration system. This represents a lost opportunity to save energy. Raising the cut-in setting of the outside air thermostat too high can cause wasted energy when the temperature differential between the inside and outside air is small and the conventional refrigeration system is more efficient than the outside air system.

It can be seen that a given outside air refrigeration system can be more efficient than the conventional refrigeration system it is auxiliary to, but only when the temperature differential between the outside air brought in and the enclosure air is great enough. Though it can vary greatly depending on the characteristics of the specific installation, this differential is typically about 4 degrees F. In this typical installation it is desirable to allow the outside air system to operate when the differential is 4 degrees or greater but not when the differential is only 3 degrees F. Because the temperature of the enclosure changes constantly, the temperature of the outside air at which it is desirable to operate the outside air system also changes constantly. A control system that does not respond to these changing conditions cannot maximize the energy savings while maintaining reliable refrigeration.

With neither the "changeover" nor the "independent" type of system is outside air automatically available to supplement the conventional refrigeration system whenever the outside air temperature is above the changeover or cut-in setting of the outside air thermostat, even when the cooling capacity of the outside air is adequate for the cooling load, or when the conventional refrigeration system is broken down or not functioning properly. In the case of a breakdown of the conventional system the enclosure temperature might rise all the way to the temperature of the surrounding heated building even if the outside temperature is many degrees cooler than that. In other words, if the changeover or cut-in setting of the outside air thermostat is 32 degrees F. then 33 degree F. outside air is not available to cool the enclosure even if the enclosure temperature rises to 40, 50, 60, or even 70 degrees F.

One common problem with outside air refrigeration systems (U.S. Pat. Nos. 4,250,716; 4,175,401; 4,023,947; 4,676,073; and 4,244,193) is that they allow pressurization of the enclosure because the pressure of the air being forced into the enclosure is not balanced by negative pressure from air being exhausted from the enclosure by another fan. Such pressurization results in cool air being forced out of the enclosure wherever it can escape, not just through the openings provided to the outside. Some of that cool air flows into the heated portions of the building, through open walk-in and reach-in doors and around imperfect gaskets for those same doors when they are closed. This results in increased energy use to heat the air to the higher temperature of the heated portion of the building.

In most conventional refrigeration systems the evaporator fans operate continuously. Their main purpose is to force air over the evaporator coils in order to transfer heat to the refrigerant inside the coils. After the cooling thermostat has been satisfied and the compressor and condenser fan have been de-energized the air forced through the evaporator by the fans continues to lose heat until the evaporator and any refrigerant are no longer colder than the rest of the enclosure, typically several minutes after the compressor has shut off. This period of time in which the evaporator fans operate after the compressor has shut off serves a useful purpose in that it helps to melt any condensate frost which may have built up on the evaporator coils during the time of compressor operation. Another purpose of the evaporator fans is to circulate the air within the enclosure so that the temperature is substantially the same throughout. Once the the residual coldness and condensate frost build-up been removed, this circulation is the only reason to want the evaporator fans to continue to operate. The electrical energy needed to operate the fans is substantial, and since all that electrical energy is converted to heat which adds to the cooling load and must be removed from the enclosure through increase operation of the refrigeration equipment, the energy cost of running the evaporator fans is compounded. It has been estimated that the average refrigeration compressor must operate two hours just to remove the heat generated by the evaporator fans in one day. The evaporator fans used are commonly selected based on their ability to transfer heat to the evaporator coils. A fan large and powerful enough to effectively remove the necessary heat from a enclosure is about ten times as large as it needs to be to simply circulate the air to even out the the temperature within the storage room. An outside air refrigeration system results in the compressor and condenser fan of the conventional refrigeration system being idle for days, weeks, or even months at a time. Evaporator fan operation is therefore only useful as a grossly overpowered circulating fan for much of the year. What is needed is a control that turns off the evaporator fans when they are not needed for evaporator cooling and defrosting and that energizes a much smaller circulating fan when the evaporator fans are not operating. Energy would be saved not only when the outside air system operates but anytime during the year the compressor is not operating. None of the outside air refrigeration systems mentioned accomplish these goals.

SUMMARY OF THE INVENTION

To avoid the limitations and problems with present methods of outside air refrigeration, it is an object of the subject invention to provide a control that will provide reliable, uninterrupted refrigeration to an enclosure such as a walk-in cooler or the like, by utilizing a differential thermostat to maximize the use of the cooling capacity of outside atmospheric air and to minimize the operation of conventional refrigeration equipment, thereby decreasing energy use.

Another object of the invention is to provide a control that will allow the outside air system to become an automatic backup to the conventional refrigeration system, providing as much refrigeration to the enclosure as the outside air temperature will allow.

Another object of the invention is to provide a new and improved method of outside air refrigeration that is both efficient and inexpensive to manufacture, install and operate.

Another object of the invention is to equalize the pressure within the enclosure to minimize the transfer of heat between the heated portions of the building and the enclosure. In the case in which the outside air can be allowed to circulate freely and mix with the air inside the enclosure, this is accomplished by means of having both an intake fan introducing outside air into the enclosure and an exhaust fan exhausting air from the enclosure to the outside atmosphere. In the case in which the outside air is too contaminated to let mix with the air inside of the enclosure air pressure equalization is accomplished by use of an air-to-air heat exchanger.

Another object of the invention is to prevent contamination of the the enclosure air or its contents through the use of an air-to-air heat exchanger.

Another object of the invention is to allow for defrosting of the heat exchanger whenever condensate icing of the heat exchanger interferes with the operation of the system.

Another object of the invention is to allow for the location of the heat exchanger either inside or outside of the enclosure.

Another object of the invention is to provide dampers to prevent the infiltration of warm humid outside air through the air passages from the outside atmosphere. Such infiltration would increase the cooling load of the enclosure and can cause condensation which can damage equipment and cause other problems.

Another object of the invention is to save energy by eliminating unnecessary evaporator operation while maintaining good air circulation throughout the enclosure by providing a control which uses a time-delay relay to de-energize the evaporator fans a pre-determined period of time after the compressor has been de-energized and to energize a much smaller circulating fan whenever to evaporator fans are not operating.

These and other objects of the invention are provided by a novel outside air refrigeration system for an enclosure with air passages to and from a source of cool outside atmospheric air or a source of air cooled by outside atmospheric air, that includes a differential thermostat to sense the temperature of both the air inside the enclosure and the outside atmospheric air, to compare them, and to actuate at least one fan or blower to circulate cool outside air so as to cool the inside of the enclosure. As long as the outside temperature is at least a pre-selected number of degrees cooler than the temperature inside the enclosure and this inside temperature is above a pre-selected cut-in temperature for the outside air refrigeration system, the outside air fan, or fans, circulate cool outside air until the temperature inside the enclosure falls to a pre-selected cut-out setting for the outside air system or until the inside temperature is cooler than a pre-selected number of degrees warmer than the outside air temperature, at which time the outside air fan, or fans turn off. The conventional refrigeration system does not operate as long as the outside air system is able to maintain the temperature of the enclosure below the pre-determined cut-in temperature setting for the conventional refrigeration system which is above the cut-in temperature setting for the outside air refrigeration system.

DESCRIPTION OF THE PREFERRED EMBODIMENT

Figure 1:
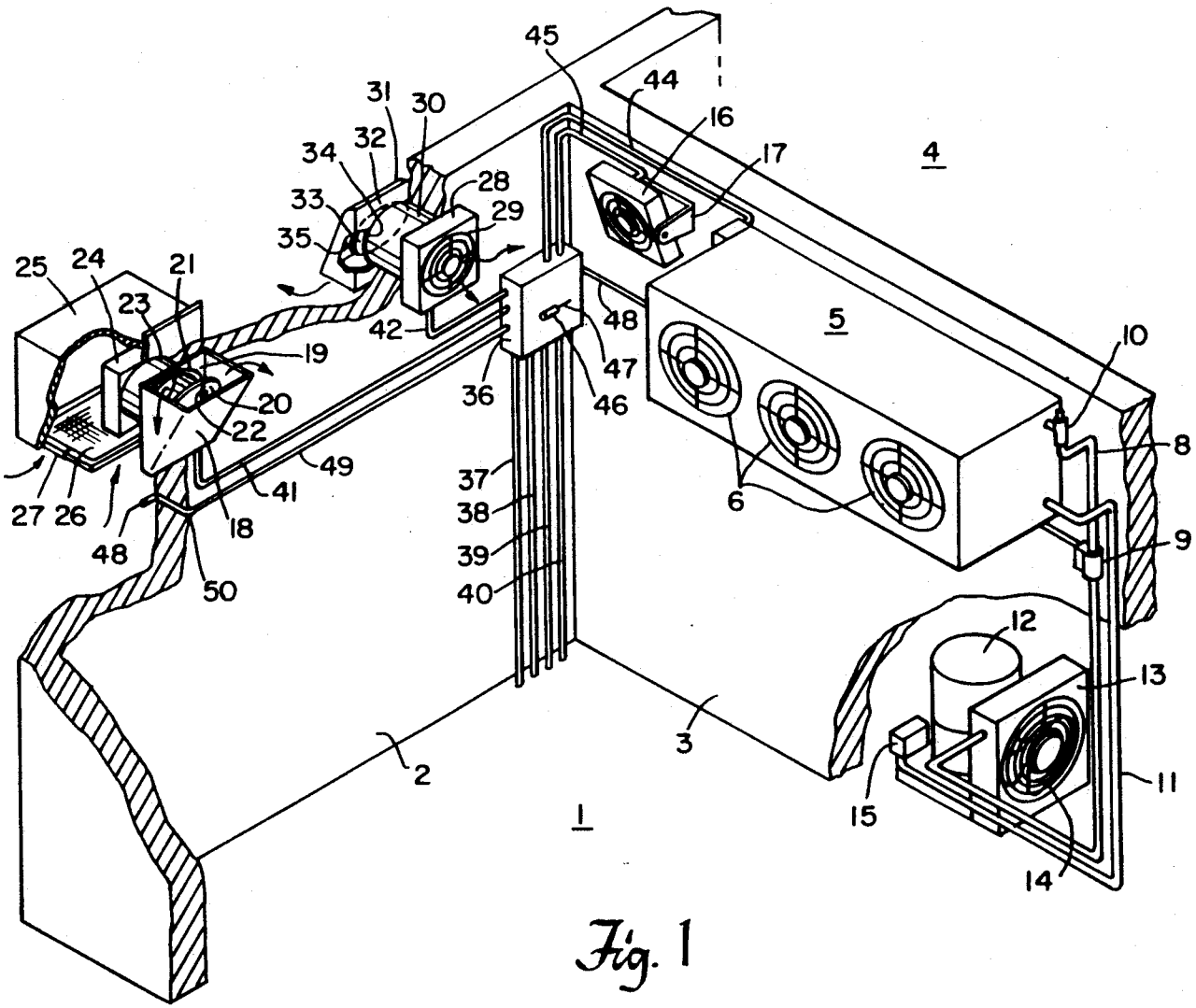
FIG. 1 is a partially cross-sectioned pictorial view of the inside of an enclosure with an outside wall which is cooled by both a conventional refrigeration system and the auxiliary outside air refrigeration system of the present invention using direct exchange of air between the enclosure and the outside atmosphere.

Referring to FIG. 1, there is shown an insulated refrigerated enclosure 1 with an outside wall 2 which separates the enclosure 1 from the outside atmosphere, and an inside wall 3 that separates the enclosure 1 from a mechanical room 4. It is to be understood that the present invention is not limited to the specific conditions herein described, but that there are many different situations in which the present invention would work well, including the case in which the enclosure is separated from the outside atmosphere by another room and the case in which the mechanical "room" is in the outside atmosphere. What is herein described is a typical situation in which a refrigerated enclosure such as a walk-in cooler or storage room is located in a building such as a grocery store or restaurant and is in a climate where the outside air temperature is cold enough to be used for refrigeration for a significant portion of the year.

In FIG. 1 there is also shown a conventional refrigeration system including an evaporator 5, with three identical evaporator fans 6 and evaporator coils 7, a refrigerant liquid line 8, a liquid line solenoid valve 9, an expansion valve 10, and a refrigerant suction line 11 inside the enclosure 1, and a compressor 12, a condenser 13, a condenser fan 14, and a low pressure control 15 inside the mechanical room 4. The conventional refrigeration system is modified by the present invention to include a circulating fan 16 which is attached to the inside wall 3 by bracket 17.

The auxiliary outside air refrigeration system includes an inside wallcap 18 that has a base 19, a damper 20, a gasket 21, and a damper closure spring 22, mounted on the inside surface of the outside wall 2, in line with a first airflow passage 23 through the outside wall 2. On th outside surface of the outside wall 2, in line with the airflow passage 23, is mounted the outside air fan 24, which is contained in an outside air fan housing 25. The outside air fan housing 25 also houses a filter 26 which is removable by sliding the filter 26 along the filter track 27. Elsewhere on the inside surface of the outside wall 2, in line with a second airflow passage 30, is an enclosure air fan 28, identical to the outside air fan 24, that has a finger guard 29 mounted on its face. In line with the second airflow passage 30, on the outside surface of the outside wall 2 is an outside wallcap 31 with a base 32, a damper 33, a gasket 34, and a damper closure spring 35.

The control panel 36 is mounted on the inside surface of the outside wall 2 and is connected to a source of power through four electrical conductors, 37, 38, 39, and 40. The control panel 36 is also connected electrically to the outside air fan 24 by an electrical conductor 41, to the enclosure air fan 28 by the electrical conductor 42, to the liquid line solenoid valve 9 by the electrical conductor 43, to the evaporator fans 6 by the electrical conductor 44, and to the circulating fan 16 by electrical conductor 45. Also, the control panel 36 is electronicly connected to an inside temperature sensor 46, a thermistor, mounted on the front of the control panel 36, by a low voltage conductor 47, and to an outside temperature sensor 48, also a thermistor, mounted on the outside surface of the outside wall 2, by a low voltage conductor 49 which passes through a hole 50 in the outside wall 2.

Figure 2:
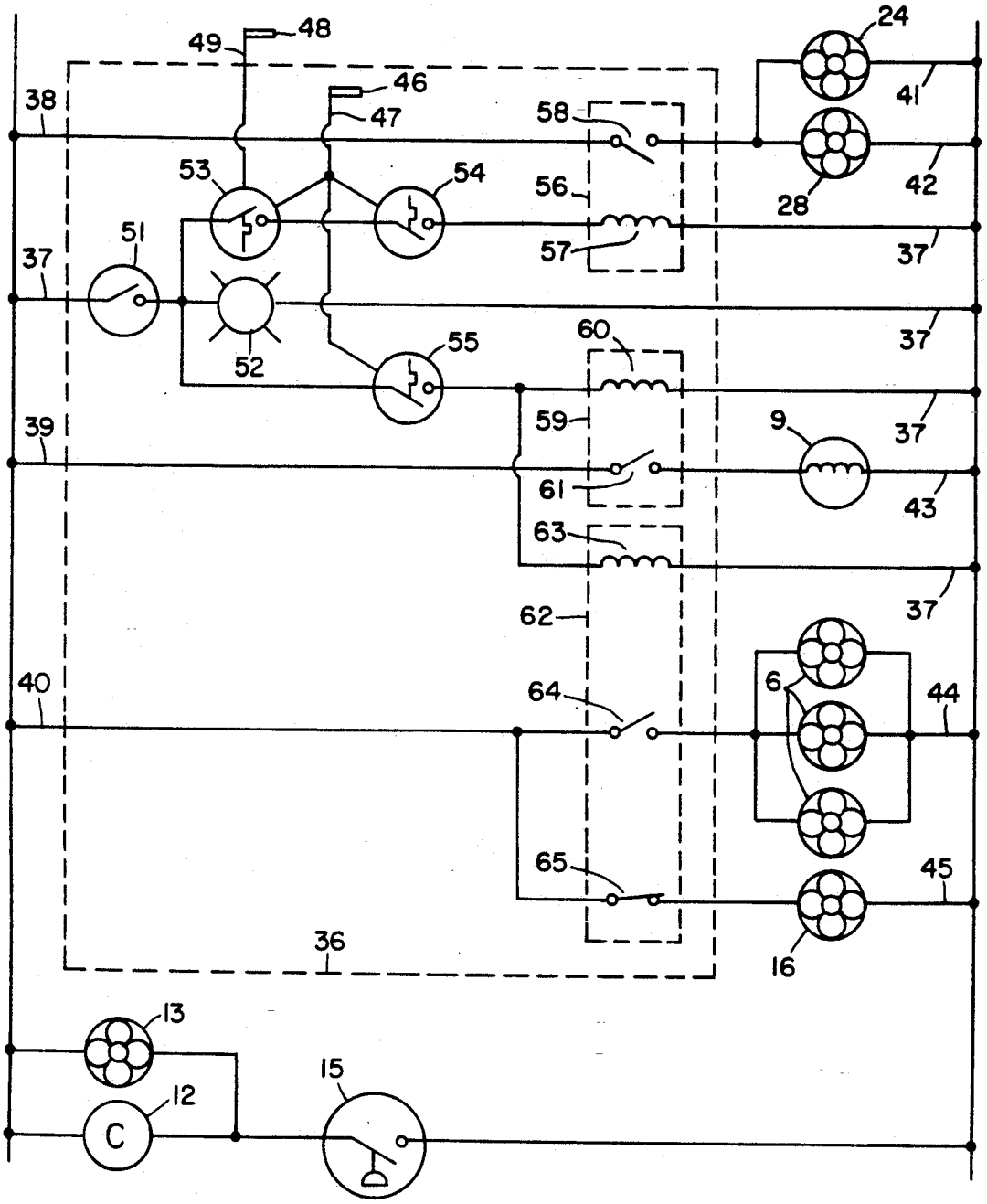
FIG. 2 is a schematic wiring diagram of a conventional refrigeration system in combination with the auxiliary outside air refrigeration system of the present invention using direct exchange of air.

Referring to FIG. 2, there is shown a schematic wiring diagram of the auxiliary outside air refrigeration system of the present invention in combination with the conventional refrigeration system. Components of the conventional refrigeration not modified by the present invention include the compressor 12 and the condenser fan 14 both of which are in series with the low pressure control 15. The control panel 36 is powered by electricity through electrical conductor 37 and is controlled by an on/off switch 51. A "power on" light 52 is in series with the switch 51. Also in series with the switch 51 is a circuit connecting a differential thermostat 53, an inside thermostat 54 for the outside air refrigeration system, and the coil 57 of an outside air refrigeration system relay 56. The circuit made by the electrical conductors 38 and 41 and the outside air fan 24 and the circuit made by the electrical conductors 38 and 42 and the enclosure air fan 28 are both controlled by the normally open contacts 58 of the relay 56. Another component in series with the switch 51, and in parallel to the outside air refrigeration system control circuit, is the inside thermostat 55 for the conventional refrigeration system. (The inside temperature sensor 46 supplies the temperature information about the air temperature inside the enclosure to the inside thermostat 55 for the conventional refrigeration system as well as for the differential thermostat 53 and the inside thermostat 54 for the outside air refrigeration system. The outside temperature sensor 48 supplies temperature information only to the differential thermostat 53.) The coil 60 of the conventional refrigeration system relay 59 and the coil 63 of the time-delay relay 62 are in series with the thermostat 55 and switch 51, but are in parallel with each other. The circuit made by electrical conductors 39 and 43 and the liquid line solenoid valve 9 is controlled by the normally open contacts 61 of the relay 59. The circuit made by electrical conductors 40 and 44 and the evaporator fans 6 is controlled by the normally open contacts 64 of the time-delay relay 62. The circuit made by the electrical conductors 40 and 45 and the circulating fan 16 is controlled by the normally closed contacts 65 of the time-delay relay 62.

The components of the conventional refrigeration system are arranged so as to extract heat from the enclosure 1 and transfer it to the mechanical room 4. The On/off switch 51 must be in the "on" (closed) position. The inside thermostat 55 in the control panel 36 replaces the thermostat which would normally control the operation of the conventional refrigeration system. When the inside sensor 46 senses that the temperature of the air is at or above the pre-determined cut-in temperature setting for the conventional refrigeration system (typically 38 degrees F.), the inside thermostat 55 closes, energizing the coil 60 of the relay 59 which closes the normally open contacts 61 making an electrical circuit through the electrical conductor 39 and 43 which energizes the liquid line solenoid valve 9. This allows liquid refrigerant to move through the refrigerant liquid line 8 and the expansion valve 10 to enter the evaporator coils 7 and evaporate. The evaporation of the refrigerant inside the evaporator coils 7 extracts heat from the enclosure air flowing past the evaporator coils 7 as a result of the operation of the evaporator fans 6. The refrigerant gas flows through the refrigerant suction line 11 through the inside wall 3 into the mechanical room 4 where the low pressure control 15 senses the pressure of the refrigerant inside the refrigerant suction line 11. Once the pressure rises to a pre-determined pressure representing the cut-in pressure setting for the conventional system the low pressure control 15 energizes the compressor 12 and the condenser fan 14 such that the refrigerant gas is compressed by the compressor 12, then the compressed hot refrigerant gas flows into the condenser 13 where it condenses as its latent and sensible heat is removed by the flow of air through the condenser 13 caused by the operation of the condenser fan 14. The liquid refrigerant is returned to the enclosure 1 via the liquid refrigerant line 8 where the process continues until the enclosure 1 is sufficiently cooled that the inside sensor 46 senses that the air temperature has dropped to the pre-determined temperature representing the cut-out temperature setting for the conventional refrigeration system (typically 36 degrees F.) This, in turn, causes the inside thermostat 55 to open, which de-energizes the coil 60 of the conventional refrigeration system relay 59, which causes the normally open contacts 61 to open, which de-energizes the liquid line solenoid valve 9, causing it to close. As the compressor 12 continues to operate the evaporated refrigerant is pumped out of the refrigerant suction line 11, which causes the pressure in it to drop until it reaches a pre-determined pressure representing the cut-out pressure setting for the compressor. This causes the low-pressure control 15 to de-energize the compressor 12 and condenser fan 14.

The conventional refrigeration system just described is one of many different systems used for refrigerating walk-in coolers and other enclosures and is not the only type of system which could work with the auxiliary outside air refrigeration system of the present invention. The conventional refrigeration system just described is a simplified version of a very common type of system called a "pumpdown" system, showing the basic elements only, and omitting many different controls and devices commonly found in such systems. A "pumpdown" system is one in which the compressor and condenser fan are electrically controlled by the low pressure control, and are not directly controlled by the inside thermostat. The inside thermostat 55 indirectly controls the operation of the compressor 12 in that it causes the liquid line solenoid valve 9 to close, which leads to the refrigerant suction line 11 being "pumped down", which eventually causes the low pressure control 15 to de-energize the compressor. The main advantage of a "pumpdown" system is that it moves almost all of the refrigerant in the system to the that part of the system lying between the compressor 12 and the liquid line solenoid valve 9, where it is not able to migrate to the suction line intake of the compressor when the compressor is idle, and in a liquid state, do great harm to the compressor when the compressor is re-energized. Migration of liquid refrigerant to an idle compressor is an especially important concern when an outside air refrigeration system can keep a compressor idle for weeks or months at a time.

An aspect of the present invention that modifies the operation of the conventional refrigeration system has to do with the circulating fan 16, the evaporator fans 6 and the time-delay relay 62. When the inside sensor 46 senses the temperature inside the enclosure 1 has risen to the pre-determined cut-in temperature setting for the conventional refrigeration system (typically 38 degrees F.), causing the inside thermostat 55 to close, the coil 63 of the time-delay relay 62 is energized. This causes the normally open contacts 64 to close, thereby energizing the evaporator fans 6, and the normally closed contacts 65 to open, thereby de-energizing the circulating fan 16. When the enclosure temperature drops to the pre-determined cut-out temperature setting of the conventional refrigeration system (typically 36 degrees F.), the inside thermostat 55 opens, the coil 63 of the time-delay relay 62 is de-energized. After a pre-determined delay, the normally open contacts 64 open, de-energizing the evaporator fans 6, and the normally closed contacts 65 close, energizing the circulating fan 16. The pre-determined delay in the operation of the contacts 64 and 65 of the time-delay relay 62 is user-adjustable to allow for extending the period of time the evaporator fans 6 operate in order allow complete defrosting of the evaporator coils 7.

The circulating fan 16 can be very much smaller and require much less energy to operate than the evaporator fans 6, because all it needs to do is circulate the air within the enclosure so that the temperature is substantially the same throughout. The operation of a small circulating fan to replace the operation of the powerful evaporator fans can reduce the energy consumed substantially because of the much smaller wattage required for the circulating fan but also because the heat that the circulating fan adds to the enclosure is much less than the heat added by the evaporator fans and this leads to reduced operating time of the refrigeration producing systems. Electrical energy is saved not just during the cold part of the year when the outside air refrigeration system is operating, but anytime that the evaporator fans are not energized. An axial fan is well suited to be used for the circulating fan 16 as it operates in this situation at substantially zero static pressure and can deliver its full free-air volume of air with very low energy consumption. The circulating fan 16 is attached near the top of the enclosure 1 by means of the mounting bracket 17, such that it can direct warmer air diagonally down and across the enclosure 1 to become mixed with cooler air near the floor. Care should be taken to mount the mounting bracket 17 in a place where maximum circulation can be maintained at all times, regardless of the loading of product within the enclosure. A position where the circulating fan 16 is blowing air down an aisle in the enclosure is a good one. The ability of the circulating fan 16 to adequately circulate the air inside enclosure is especially critical during periods of frigid weather when the auxilary outside air refrigeration system brings intensely cold air into the enclosure. If this cold air is not well circulated throughout the enclosure it will stratify such that freezing temperatures can occur near the floor, while the inside sensor, mounted high off the floor, will not sense these freezing conditions and will not de-energize the outside air fans in time to prevent damage to items near the floor.

Referring now to FIGS. 1 and 2, the operation of the auxiliary outside air refrigeration system of the present invention can be described. The outside air refrigeration cycle begins when the outside sensor 48 senses that the temperature of the outside atmospheric air is cooler than a pre-selected number of degrees cooler than the temperature of the air inside the enclosure 1, sensed by the inside sensor 46, which represents the cut-in temperature differential for the outside air refrigeration system (typically 6 degrees F.). This causes the differential thermostat 53 to close. When the inside sensor 46 also senses that the temperature inside the enclosure 1 is at or above the cut-in temperature setting for the outside air refrigeration system (typically 36 degrees F.), this causes the inside thermostat 54 for the outside air refrigeration system to also close. Since both the thermostats 53 and 54 and the switch 51 are in series, when they are all in a closed position they cause the coil 57 of the outside refrigeration system relay 56 to be energized. This, in turn, causes the normally open contacts 58 to close, which energizes the outside air fan 24 (through electrical conductors 38 and 41) and the enclosure air fan 28 (through electrical conductors 38 and 42).

When the outside air fan 24 is energized it draws outside atmospheric air through the filter 26 into the outside air fan housing 25. The air is then forced through the first airflow passage 23 and the inside wallcap base 19 where the force exerted by the incoming air overcomes the force exerted by the damper closure spring 22 and opens the damper 20 allowing the outside air to pass through the inside wallcap 18 and enter the enclosure 1. When the enclosure air fan 28 is energized, it draws air from the enclosure 1, through the finger guard 29 and forces the air into the second airflow passage 30 and through the outside wall cap base 32 where the force exerted by the air overcomes the force exerted by the damper closure spring 35 and opens the damper 33 allowing the enclosure air to flow through the outside wallcap 31 into the outside atmosphere.

The simultaneous operation of the two fans 24 and 25 results in a gradual lowering of the air temperature within the enclosure. When the inside sensor 46 senses that the air temperature within the enclosure has reached the pre-determined cut-out temperature setting for the outside air refrigeration system (typically 34 degrees F.), the inside thermostat 54 opens, which de-energizes the coil 57 of the relay 56, which opens the normally open contacts 58, which, in turn, de-energizes the fans 24 and 28, stopping the flow of outside air into the enclosure 1. The operation of the two fans 24 and 28 is also stopped when the outside sensor 48 senses that the outside temperature has risen (or the inside temperature has dropped) so as to make the outside temperature warmer than a pre-determined number of degrees cooler than the inside temperature, as sensed by the inside sensor 46, which represents the cut-out temperature differential setting for the outside air refrigeration system (typically 4 degrees F.), which causes the differential thermostat 53 to open, de-energizing the coil 58 of the relay 56, causing the contacts 58 to open and thereby de-energizing the fans 24 and 28.

The cut-out temperature differential setting for the outside air refrigeration system is selected so as to cause the operation of the fans 24 and 28 when the amount of cooling provided by those fans is greater than the amount of cooling provided by the conventional refrigeration system while consuming an equal amount of electrical energy. The "breakeven point" at which the outside air refrigeration system is equally as energy efficient as the conventional refrigeration system is typically reached when the outside air temperature is about 4 degrees F. cooler than the temperature inside the enclosure. Therefore, a differential of about 4 degrees is the smallest differential that should be used in order to minimize the use of energy.

The cut-in temperature differential is selected so as to maximize the operation of the outside air refrigeration system without causing unacceptable short-cycling of the fans 24 and 28. A relatively small hysteresis, or difference between the cut-in and cut-out temperature differential settings, typically about 2 degrees F., is all that is needed. A larger hysteresis leads to unnecessary loss of operation of the outside air system and a smaller hysteresis can result in the fans 24 and 28 cycling on and off too frequently.

Because when the outside air refrigeration system operates it is more efficient than the conventional refrigeration system, to minimize energy use it is necessary to operate the conventional system only when the outside air system cannot maintain a cool enough temperature inside the enclosure. This is accomplished by having the inside thermostat 55 for the conventional refrigertation system have a higher operating temperature range than the inside thermostat 54 for the outside air refrigeration system. Typically, for inside thermostat 55 for the conventional system, the cut-in temperature setting is 38 degrees F. and the cut-out setting is 36 degrees F., and for the inside thermostat 54 for the outside air system, the cut-in temperature setting is 36 degrees F. and the cut-out setting is 34 degrees F. As long as the outside air system can keep the temperature inside the enclosure from rising to 38 degrees F. the conventional system will not operate.

The two systems are wired in parallel, so they can operate simultaneously under certain conditions. While simultaneous operation will cause electricity to be consumed at a higher instantaneous rate than with the operation of either system alone, less electricity will be used in supplying a given amount of refrigeration to the enclosure than would be used in supplying that amount of refrigeration by the operation of the conventional refrigeration system alone. Because each refrigeration system operates independently of the other, each can act as a back-up for the other. When the cooling load is too large for the cooling capacity of the outside air system, the conventional system can operate and supply whatever cooling is needed to maintain proper refrigeration. When the conventional system cannot pull the temperature of the enclosure down to an acceptable refrigeration temperature because of the introduction of a large product heat load, or due to partial or complete system failure, the outside air system can serve as a partial or complete back-up by supplying as much cooling as the outside temperature will allow. If the compressor is broken and the outside temperature is 45 degrees F., the outside air system may be able to provide enough cooling to keep the temperature of the enclosure at 50 degrees F. instead of the 60 to 70 degrees F. it might rise to without any back-up cooling at all. Such partial auxialary cooling could greatly reduce spoilage of perishable food and keep other products such as beer or soda at an acceptable temperature for consumer purchase.

The embodiment of the present invention just described utilizes a single, unified control panel 36 for both refrigeration systems, using a single thermistor, the inside temperature sensor 46, to inform each of the three thermostats, 53, 54, and 55, as to the temperature inside the enclosure. The present invention would also apply to the use of three separate thermostats, each with their own inside temperature sensor (thermistor, capillary tube, bi-metal or ohter type of sensor). A unified control using a single inside sensor eliminates the redundancy and inaccuracy of having multiple sensors. A single inside sensor keeps the relationship between the different operating temperature ranges of the two refrigeration systems constant, allowing a single setpoint, in between the two operating ranges, to be all that a user need adjust to change the temperature of the enclosure. The number of degrees of hysteresis for each thermostatic function and the relationship between the different operating temperature ranges could be adjustable by opening the control housing, but simply raising or lowering the temperature setting should be easily done by an average person without having such adjustment affect the operational relationship between the two refrigeration systems.

The simultaneous operation of the outside air fan 24 and the enclosure air fan 28 causes the pressure inside the enclosure to be substantially equal to atmospheric pressure. This avoids the problems with pressurization of the enclosure that would result from the operation or an outside air fan alone.

The prevention of condensation caused by warm moist air coming into contact with the cold metal surfaces of fans and other equipment is an important consideration. There is a need for the damper closure spring 35 to keep the damper 33 especially tight-fitting against the gasket 34, as any warm outside air that leaks into the enclosure around this gasket will come into contact with the enclosure air fan 28 and the resulting condensation could cause premature failure of the fan, especially the bearings. The outside air fan 24 is located outside the enclosure 1, and since it is the same temperature as the surrounding atmospheric air, it is not as subject to condensation problems.

The enclosure fan 28 and the outside air fan 24 is positioned far enough apart so that cold air entering the enclosure through the first airflow passage 23 does not "short circuit" and immediately exit the enclosure through the second airflow passage 30 without first mixing with the air inside the enclosure. The inside wallcap 18 is well separated from the enclosure air fan 28 and is mounted so as to direct the flow of cold air upwards where it can mix with any warm air that may be at the top of the enclosure. The flow of air from each of the fans inside the enclosure 1, the outside air fan 24, the circulating fan 16, and the evaporator fans 6, is directed so as to create as little interference with each other and with anything else inside the enclosure and to promote the maximum circulation of air within the enclosure.

The outside wall 2 of the enclosure 1 does not necessarily have to have a surface that is in the outside atmosphere, but could be an inside wall of an intermediate space between the enclosure 1 and the outside atmosphere. In that case, there would be insulating ducts linking the outside wall 2 with the wall that actually had a surface that was in the outside atmosphere. The present invention is also not limited to connecting the enclosure with the outside atmosphere through the enclosure walls, but could also apply to the cases in which access to the outside atmosphere is made by air passages through the floor or ceiling of the enclosure.

The filter 26 is designed to block the entry of insects, birds, and small animals into the outside air fan housing 25 and into the enclosure itself, as well as to remove contaminants from the outside air flowing into the enclosure. The outside air fan housing 25 is designed so that the filter 26 has a large enough cross-section and a limited resistance to airflow so as to minimally restrict the flow of air into the enclosure 1. It could be a permanent filter that could be periodically removed for cleaning by sliding it along the filter track 27, or it could be a disposable filter that could be periodically replaced.

A fairly porous filter is all that is usually needed when the product inside the enclosure is well sealed in bottles, cans, or boxes but sometimes more perishable food in open containers needs to be protected from air that can be very polluted, especially in a city or congested area. A disposable charcoal "HEPA" filter can be used in this situation, since it can remove airborne particles of extremely small size, but even this solution is not perfect, as some very small particles and some noxious gases and fumes can still pass through a "HEPA" filter, it becomes less effective with use, and it can be expensive to replace. The better a filter is at filtering out contaminants the more the flow of air is restricted, so a very good filter can restrict airflow so much that efficiency is sacrificed. When a better filter is not reasonable solution and the need to eliminate all outside air pollution from an enclosure is great, use of another embodiment of the present invention, an auxiliary outside air refrigeration system with an air-to-air heat exchanger, is needed.

Another potential problem with an outside air refrigeration system using direct exchange of air is that excessive drying of some products, such as uncovered food, produce, or flowers within the enclosure can occur when very cold outside air is circulated, because very cold air is also very dry. Use of an air-to-air heat exchanger greatly reduces this problem as the dry outside air is not allowed to mix with the air inside the enclosure.

Figure 3:
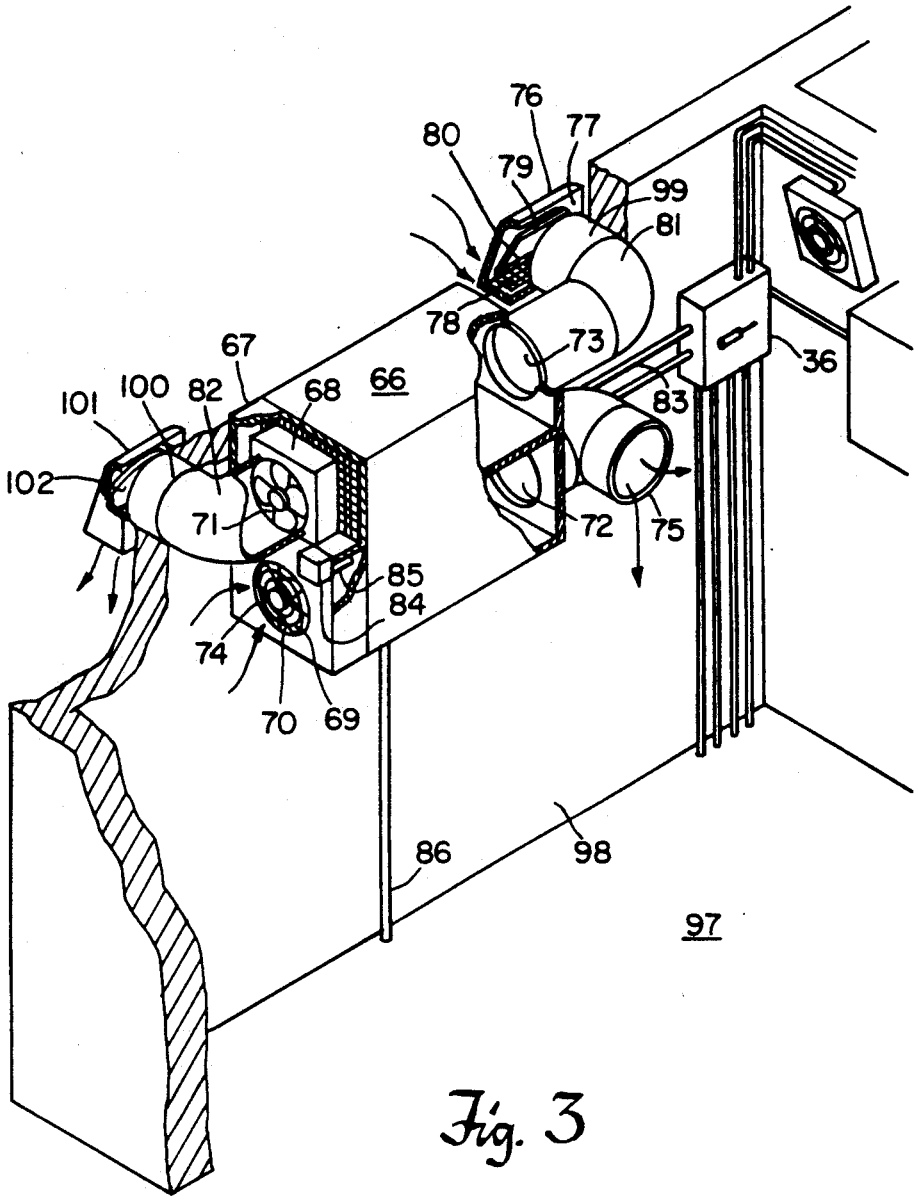
FIG. 3 is a partially cross-sectioned pictorial view showing the auxiliary outside air refrigeration system of the present invention using an air-to-air heat exchanger with the heat exchanger mounted on the inside surface of the outside wall of the enclosure.

Referring to FIG. 3, there is shown an air-to-air heat exchanger 66 mounted on the inside surface of the outside wall 98 of the enclosure 97. Attached to one end of the heat exchanger 66 is a heat exchanger fan housing 67, containing an outside air fan 68 and an enclosure air fan 69. There are two openings into the heat exchanger fan housing 67, the enclosure air inlet 70 and the outside air outlet 71. There are two openings into the heat exchanger 66, the enclosure air outlet 72, and the outside air inlet 73. A finger guard 74 covers the enclosure air inlet 70 and an adjustable air diverter 75 is attached to the enclosure air outlet 72. An outside air intake wallcap 76, having of a base 77, a screen 78, a damper 79 and a damper hinge 80, is mounted on the outside surface of the outside wall 98 in line with one end of the first air passage 99, the other of which is connected to one end of an outside air inlet duct 81, the other end of which is attached to the outside air inlet 73 of the heat exchanger 66. The outside air outlet 71 is connected to one end of an outside air exhaust duct 82, the other end of which is connected to the second airflow passage 100. An electrical conductor 83 connects the control panel 36 with the heat exchanger fan housing 67. A pressure switch 84 has a pressure sensor 85 that measures the pressure downstream of the enclosure air fan 69. A condensate drain 86 is connected to the bottom of the heat exchanger 66 and drains condensate from the heat exchanger 66 to a point outside the enclosure 97.

Figure 4:
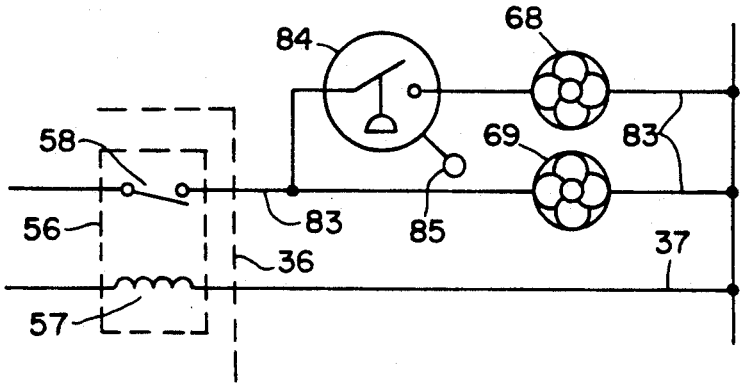
FIG. 4 is a schematic wiring diagram showing that portion of the outside air refrigeration system of the present invention that applies to the use of an air-to-air heat exchanger.

Referring to FIG. 4, there is shown a wiring schematic for that portion of the electrical circuitry that applies to the use of an air-to-air heat exchanger. The outside air refrigeration relay 56 located inside the control panel 36, has coil 57, which controls the normally open contacts 58, just as in the wiring schematic of FIG. 2. When an air-to-air heat exchanger is used the contacts 58 are connected in series to the electrical conductor 83. The enclosure air fan 69 and the outside air fan 68 are wired in series to the electrical conductor 83 and in parallel to each other. The pressure switch 84 is wired in series to the outside air fan 68, but in parallel to the enclosure fan 69.

When the control panel 36 calls for operation of the auxiliary outside air refrigeration system, the normally open contacts 58 of the relay 56 close, supplying voltage to electrical conductor 83 which energizes enclosure air fan 69. If the pressure sensor 85 senses that the pressure of the air downstream of the enclosure air fan 69 is below a pre-determined pressure representing the cut-out pressure setting for the heat exchanger defrost control, then the outside air fan 68 is also energized. When the enclosure air fan 69 is energized, air from the enclosure is drawn through the finger guard 74 and the enclosure inlet 70 into the enclosure air fan 69 and forced through the air-to-air heat exchanger 66 so that it exhausts through the enclosure air outlet 72 and the enclosure air diverter 75 back into the enclosure. When the outside air fan 68 is energized, outside air is drawn into the outside air intake wallcap 76 through the screen 76 and past the damper 79, through the wallcap base 77, through the first airflow passage 99, through the outside wall 98, through the outside air inlet duct 81, through the outside air inlet 73, through the air-to-heat exchanger 66 (where it does not mix with the enclosure air passing through the heat exchanger 66 by a separate path) and then is drawn into the outside air fan 68, which forces the air out through the outside air outlet 71, through the outside air exhaust duct, through the second airflow passage 100, through the outside wall 98, through the outside wallcap 101, past the damper 102, where the air exhausts to the outside atmosphere.

When both of the airflows are simultaneously passing through the air-to-air heat exchanger 66 via their separate paths, the two airflows do not mix, but some of the heat from the enclosure air is transferred to the outside air through the interior walls of the heat exchanger. The exact paths that the two airflows take in their travel through the air-to-air heat exchanger will vary from one manufacturer to the next. There are many makes of heat recovery ventilators for supplying fresh air to buildings without significant heat loss that can be used as well as other types of air-to-air heat exchangers, but it is outside the scope of the present invention to go into further detail of their internal construction.

The heat that is lost by the enclosure air as it travels through the heat exchanger 66 results in a reduction in the temperature of that air when it is exhausted from the heat exchanger. It is by this means that heat is transfered to the outside atmosphere from the enclosure 97 and the enclosure is thereby refrigerated. The amount of refrigeration supplied to the enclosure by this auxiliary outside air system is dependent on the temperature differential between the outside air and the air inside the enclosure, the amount of air moved by each of the two fans 68 and 69 through the heat exchanger 66, and the heat transferring ability of the heat exchanger 66.

The control system for an auxiliary outside air refrigeration system using a heat exchanger is the same as that of the outside air refrigeration system using direct exchange of air previously described, except for the measures taken to deal with defrosting of condensate ice within the heat exchanger. As air from the enclosure 97 passes through the heat exchanger 66 it come into contact with heat exchange surfaces which have been cooled from the other side by outside air that is cooler than the air inside the enclosure. This results in moisture from the enclosure air condensing on these heat exchange surfaces and if the temperature of those surfaces are cold enough this moisture turns to ice. If enough ice forms on these surfaces the air passages inside the heat exchanger 66 become smaller and the flow of enclosure air through the heat exchanger 66 is greatly reduced. The reduction of airflow through the heat exchanger 66 results in a lowering of the efficiency of the outside air refrigeration system, which creates a need to defrost the heat exchanger 66. The reduction in the size of the airflow passages inside the heat exchanger 66 due to condensate icing also increases the pressure downstream of the enclosure air fan 69, which is sensed by the pressure sensor 85. If the sensor 85 senses that the pressure downstream of the enclosure air fan 69 is above the pre-determined pressure representing the cut-out pressure setting for the heat exchanger defrost control, the pressure switch 84 opens and the outside air fan 68 is de-energized. This stops the flow of cold outside air through the heat exchanger 66 and the continued flow of enclosure air through the heat exchanger 66, because the temperature of that air is above 32 degrees F., causes the condensate ice to melt. When enough of the condensate ice melts to enlarge the airflow passages within the heat exchanger 66 and to decrease the pressure downstream of the enclosure air fan 69 to below the pre-determined pressure representing the cut-out pressure setting for the heat exchanger defrost control, the pressure sensor 85 causes the pressure switch 86 to close, which energizes the outside air fan 68, which allows the outside air refrigeration system to deliver refrigeration to the enclosure 97 again.

The condensate drain 86 removes any condensate which forms on the heat exchange surfaces inside the heat exchanger 66 in contact with the flow of enclosure air and drains by gravity immediately after forming or after melting of the condensate ice during the defrost cycle, and carries it to a suitable disposal point outside the enclosure 97.

The outside air wallcap 76, because it is bringing air into the enclosure in the opposite direction from most wallcaps, has a hinge 80 that allows the damper 79 to open when the operation of the outside air fan 68 causes air flowing from the outside toward the wall 98 to exert enough force to overcome the force of gravity that acts to close the damper 79 when the outside air fan 68 stops.

The outside air fan 68 should be placed downstream of the heat exchanger 66 and the enclosure air fan 69 placed upstream of the heat exchanger 66, as it is in the embodiment shown, so that if there is any leakage between the two airflows, any contamination in the outside air will not tend to pass into the enclosure 97. This is because this arrangement creates greater pressure within the air passages in the heat exchanger 66 for the flow of enclosure air than within those for the flow of outside air.

One of the possible drawbacks of the outside air refrigeration system shown in FIG. 3 is that the relatively large amount of space that the heat exchanger 66 occupies may be excessive if that space inside the enclosure is needed for product storage. In another embodiment of the present invention a solution to this problem is locating the heat exchanger 66 outside the enclosure 97, either in an intermediate space within the building or in the outside atmosphere. This is what is shown in FIG. 5.

Figure 5:
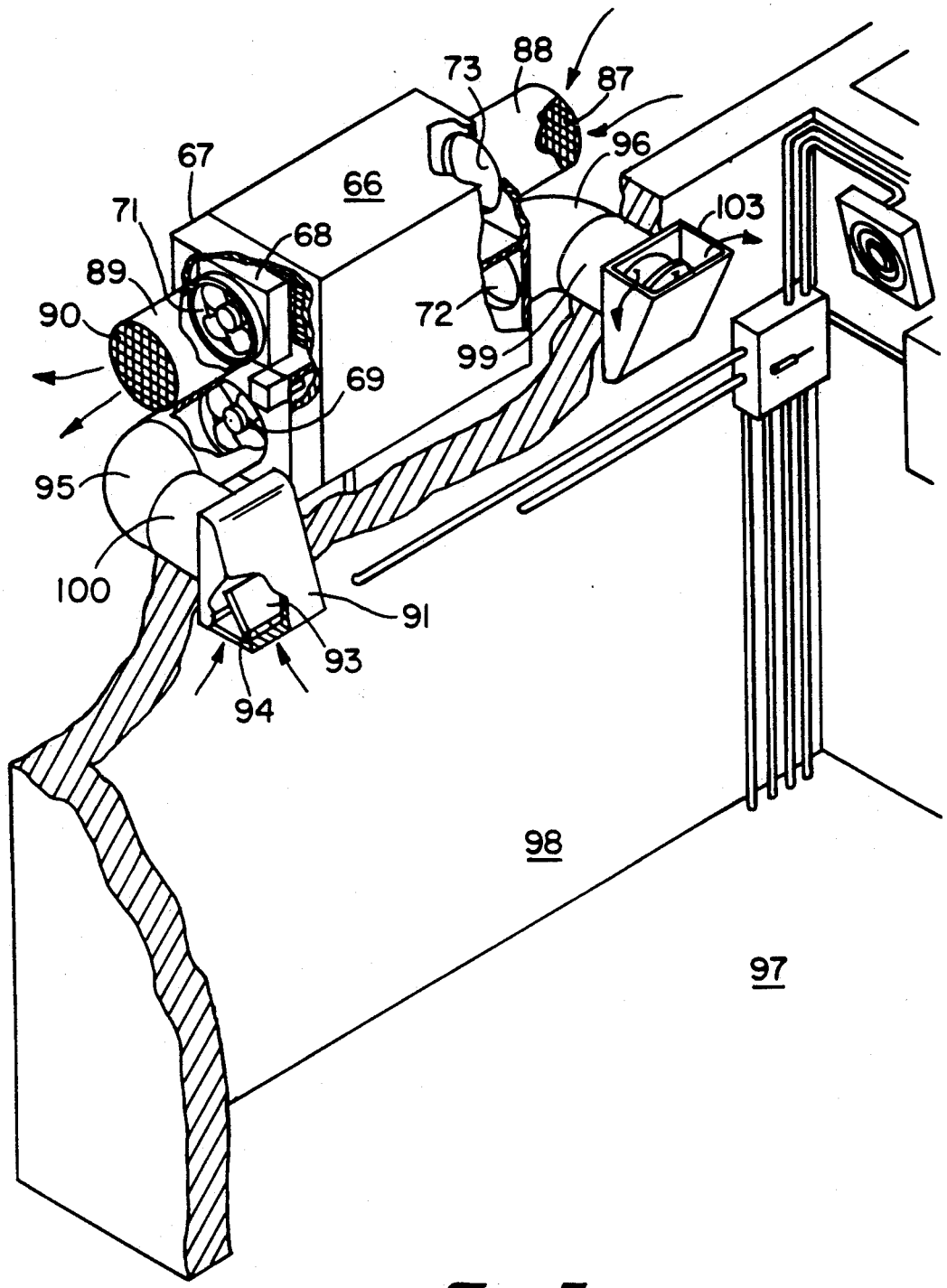
FIG. 5 is a partially cross-sectioned pictorial view of the air-to-air heat exchanger mounted on the outside surface of the outside wall of the enclosure.

Referring to FIG. 5, there is shown the air-to-air heat exchanger 66, attached to the heat exchanger fan housing 67, mounted on the exterior surface of the outside wall 98 of the enclosure 97. The outside air fan 68 draws outside air through the screen 87, the outside air intake duct 88, the outside air inlet 73, and, the heat exchanger 66, and exhausts it through the outside air outlet 71, the outside air exhaust duct 89, and the screen 90 to the outside atmosphere. The outside air intake duct 88 and exhaust duct 89 are as long as is necessary to reach a source of outside atmospheric air. The enclosure air fan 69 draws enclosure air into the inside wallcap 91, through the second airflow passage 100, through the enclosure air intake duct 95, and forces it through the heat exchanger 66, the enclosure air outlet 72, the enclosure air exhaust duct 96, the first airflow passage 99, and the inside wallcap 103, back into the enclosure 97.

The inside wallcap 91 is similar to the outside air wallcap 76 in FIG. 3 in that it has a hinge 94 that allows the damper 93 to open upward when the force of air drawn in by the enclosure air fan 69 overcomes the force of gravity that closes the damper 93 when the enclosure air fan 69 is de-energized.

In all other respects, the operation of the outside air refrigeration system shown in FIG. 5 is the same as that in FIG. 3.

Although the invention is described with respect to preferred embodiments, modifications thereto will be apparent to those skilled in the art. Therefore, the scope of the invention is to be determined by reference to the claims which follow.

I claim:

1. An auxiliary outside air refrigeration system for cooling an enclosure comprising:

a conventional refrigeration system consisting of a compressor, a condenser, and an evaporator which is operably disposed to cool the air inside the enclosure;

a first airflow passage connecting the interior of the enclosure with a source of ambient air from the exterior of the enclosure;

a motorized outside air fan positioned to move cooler air from the exterior of the enclosure through the first airflow passage into the enclosure;

a second airflow passage connecting the interior of the enclosure with the exterior of the enclosure;

an outside temperature sensor to sense the temperature of the outside air;

an inside temperature sensor to sense the temperature of the air inside the enclosure;

an electrical differential thermostatic control means in communication with the inside and outside temperature sensors and in electrical communication with the outside air fan whereby the outside air fan is actuated whenever the air inside of the enclosure is warmer than a first pre-determined temperature representing the cut-in temperature of the enclosure for the outside air refrigeration system, and the outside atmospheric air is cooler than a first pre-determined number of degrees cooler than the air inside the enclosure representing the cut-in temperature differential for the outside air refrigeration system, whereby cool air is introduced into the enclosure through the first airflow passage and warmer air is exhausted from the enclosure through the second airflow passage, until the air inside the enclosure reaches a second pre-determined temperature representing the cut-out temperature of the enclosure for the outside air refrigeration system, at which time the outside air fan is de-actuated, the outside air fan also being de-actuated whenever the outside air temperature is warmer than a second pre-determined number of degrees cooler than the air temperature inside the enclosure representing the cut-out temperature differential for the outside air refrigeration system and, a thermostatic control means by which the compressor of the conventional refrigeration system is actuated whenever the temperature of the air inside the enclosure is above a third pre-determined temperature which represents the cut-in temperature of the enclosure for the conventional system and which is warmer than the cut-in temperature of the enclosure for the outside air refrigeration system, such that the compressor does not operate as long as the outside air refrigeration system is effectively cooling the air inside the enclosure.

2. The auxiliary outside air refrigeration system of claim 1, in which outside atmospheric air flowing through the first airflow passage into the enclosure becomes mixed with the air inside the enclosure, and air inside the enclosure flowing through the second airflow passage becomes mixed with the outside atmosphere.

3. The auxiliary outside air refrigeration system of claim 2, in which a filter is located such that the air flowing from the outside atmosphere through the first airflow passage into the interior of the enclosure passes through the filter and contaminants are thereby removed from the air.

4. The auxiliary outside air refrigeration system of claim 2, in which a motorized enclosure air fan moves air from the enclosure through the second airflow passage to the outside atmosphere at substantially the same rate as the outside air fan moves outside air through the first airflow passage into the enclosure such that the air pressure inside the enclosure is substantially the same as atmospheric pressure, and the control means actuates and de-actuates the outside air fan and enclosure air fan simultaneously.

5. The auxiliary outside air refrigeration system of claim 4, in which a first damper is located so as to block the flow of air from the outside atmosphere through the first airflow passage into the enclosure whenever the outside air fan is not operating, and is disposed to open to allow airflow whenever the outside air fan is operating and, a second damper is located so as to block the flow of air from the enclosure through the second airflow passage to the outside atmosphere whenever the enclosure fan is not operating, and is disposed to allow airflow whenever the enclosure air fan is operating.

6. The auxiliary outside air refrigeration system as in claim 1, in which the control means of the conventional refrigeration system includes a time-delay relay such that when the thermostatic control circuit of the conventional refrigeration system is actuated the evaporator fan or fans are actuated simultaneously, and when the thermostatic control circuit of the conventional refrigeration system is de-actuated the evaporator fan or fans continue to operate for a pre-determined amount of time, after which they are also de-actuated, 7. The auxiliary outside air refrigeration system as in claim 6 in which whenever the evaporator fan or fans are de-actuated a circulating fan or fans are actuated in order to circulate the air inside the enclosure, and whenever the circulating fans are de-actuated the evaporator fan or fans are actuated.

8. An auxiliary outside air refrigeration system for cooling an enclosure comprising:

a conventional refrigeration system consisting of a compressor, a condenser, and an evaporator which is operably disposed to cool the air inside the enclosure;

an air to air heat exchanger with two pairs of inlets and outlets for receiving and recirculating two separate air supplies from two separate sources, a heat exchange means for transferring heat from one air supply to the other without mixing the two air supplies together, a first inlet and outlet in communication with outside atmospheric air, and a second inlet and outlet in communication with the air inside the enclosure, an outside air fan positioned to move outside atmospheric air into the first inlet of the heat exchanger, through the heat exchanger, and out of the first outlet of the heat exchanger so that it returns to the outside atmosphere, and an enclosure air fan positioned to move air from the enclosure into the second inlet of the heat exchanger, through the heat exchanger, and out of the second outlet of the heat exchanger so that it returns to the enclosure;

an outside temperature sensor to sense the temperature of the outside air;

an inside temperature sensor to sense the temperature of the air inside the enclosure;

an electrical differential thermostatic control means in communication with said inside and outside temperature sensors and in electrical communication with said outside air fan and said enclosure air fan whereby the outside air fan and enclosure air fan are actuated whenever the air inside the enclosure is warmer than a first predetermined temperature representing the cut in temperature of the enclosure for the outside air refrigeration system, and the outside atmospheric air is cooler than a first predetermined number of degrees cooler than the air inside the enclosure representing the cut in temperature differential for the outside air refrigeration system, whereby enclosure air is circulated into said second inlet and through said heat exchanger and out said second outlet until the air inside the enclosure reaches a second predetermined temperature representing the cut out temperature of the enclosure for the outside air refrigeration system, at which time the outside air fan and said enclosure air fan are deactuated, the outside air fan and the enclosure air fan also being deactuated whenever the outside air temperature is warmer than a second predetermined number of degrees cooler than the air temperature inside the enclosure representing the cut out temperature differential for the outside air refrigeration system; and means for actuating the compressor of the conventional refrigeration system whenever the temperature inside the enclosure is above a third predetermined temperature which represents the cut in temperature of the enclosure for the conventional system and which is warmer than the cut in temperature of the enclosure for the outside air refrigeration system, such that the compressor does not operate as long as the outside air refrigeration system is effectively cooling the air inside the enclosure.

9. An auxiliary outside air refrigeration system for cooling an enclosure comprising:

conventional refrigeration means;

auxiliary refrigeration means including means to introduce ambient air into the enclosure, and ambient air temperature sensor means;

enclosure air temperature sensor means; and differential control means, responsive to said conventional refrigeration means, said auxiliary refrigeration means, and said enclosure air temperature sensor means including means to actuate at least said auxiliary refrigeration means each time and only when the enclosure air temperature is warmer than a first predetermined amount and the ambient air temperature is cooler than the enclosure air temperature by a second predetermined amount, said differential control means further including means to actuate said conventional refrigeration means when the enclosure air temperature is warmer than said first predetermined amount and the ambient air temperature is not cooler than the enclosure air temperature by said second predetermined amount.

10. An auxiliary outside air refrigeration system for cooling an enclosure comprising:

conventional refrigeration means;

auxiliary refrigeration means including heat exchanger means for receiving ambient air and enclosure air and transferring heat therebetween, and ambient air temperature sensor means;

enclosure air temperature sensor means; and differential control means, responsive to said conventional refrigeration means, said auxiliary refrigeration means, and said enclosure air temperature sensor means including means to actuate at least said heat exchanger means each time and only when the enclosure air temperature is warmer than a first predetermined amount and the ambient air temperature is cooler than the enclosure air temperature by a second predetermined amount, said differential control means further including means to actuate said conventional refrigeration means when the enclosure air temperature is above said first predetermined amount and the ambient air temperature is not cooler than the enclosure air temperature by said second predetermined amount.

11. The auxiliary outside air refrigeration system using a heat exchanger as in claim 10, in which:

the control means includes a sensor that detects the pressure of the enclosure air flowing through the heat exchanger and whenever the sensor detects a pre-determined rise in pressure corresponding to a build-up of condensate ice within the heat exchanger, the control means de-actuates the outside air fan which stops the flow of outside air through the heat exchanger, while continuing to actuate the enclosure air fan until the flow of enclosure air through the heat exchanger melts the condensate ice which increases airflow so that the enclosure air pressure returns to normal, and the control means re-actuates the outside air fan and, the water that condenses inside the heat exchanger is drained out of the heat exchanger by means of a condensate drain.

12. An auxiliary outside air refrigeration system for cooling an enclosure comprising:

conventional refrigeration means;

auxiliary refrigeration means including means to introduce ambient air into the enclosure, and ambient air temperature sensor means;

enclosure air temperature sensor means; and differential control means, responsive to said conventional refrigeration means, said auxiliary refrigeration means, and said enclosure air temperature sensor means including means to actuate at least said auxiliary refrigeration means each time and only when the enclosure air temperature is warmer than a first predetermined amount and the ambient air temperature is cooler than the enclosure air temperature by a second predetermined amount, said differential control means further including means to actuate said conventional refrigeration means when the enclosure air temperature is warmer than a third predetermined amount and the ambient air temperature is not cooler than the enclosure air temperature by said second predetermined amount.

13. An auxiliary outside air refrigeration system for cooling an enclosure comprising:

conventional refrigeration means;

auxiliary refrigeration means including heat exchanger means for receiving ambient air and enclosure air and transferring heat therebetween, and ambient air temperature sensor means;

enclosure air temperature sensor means; and differential control means, responsive to said conventional refrigeration means, said auxiliary refrigeration means, and said enclosure air temperature sensor means including means to actuate at least said heat exchanger means each time and only when the enclosure air temperature is warmer than a first predetermined amount and the ambient air temperature is cooler than the enclosure air temperature by a second predetermined amount, said differential control means further including means to actuate said conventional refrigeration means when the enclosure air temperature is above a third predetermined amount and the ambient air temperature is not cooler than the enclosure air temperature by said second predetermined amount.

* * * * *